US012371630B2

(12) United States Patent
Levine et al.

(10) Patent No.: US 12,371,630 B2
(45) Date of Patent: Jul. 29, 2025

(54) ADDITIVES AND METHODS FOR IMPROVING FLOW PROPERTIES OF CRUDE OIL

(71) Applicant: RJ LEE GROUP, INC., Monroeville, PA (US)

(72) Inventors: Alan M. Levine, Monroeville, PA (US); Richard J. Lee, Murrysville, PA (US); Steven J. Monaco, Venetia, PA (US); Jonathan Lyle Wistrom, Maryville, MO (US)

(73) Assignee: RJ LEE GROUP, INC., Monroeville, PA (US)

( * ) Notice: Subject to any disclaimer, the term of this patent is extended or adjusted under 35 U.S.C. 154(b) by 0 days.

(21) Appl. No.: 18/271,590

(22) PCT Filed: Jan. 12, 2022

(86) PCT No.: PCT/US2022/012071

§ 371 (c)(1),
(2) Date: Jul. 10, 2023

(87) PCT Pub. No.: WO2022/155166

PCT Pub. Date: Jul. 21, 2022

(65) Prior Publication Data

US 2024/0076569 A1 Mar. 7, 2024

Related U.S. Application Data

(60) Provisional application No. 63/136,360, filed on Jan. 12, 2021.

(51) Int. Cl.
*C10L 10/18* (2006.01)
*C10L 1/16* (2006.01)

(52) U.S. Cl.
CPC ..... *C10L 10/18* (2013.01); *C10L 1/1616* (2013.01); *C10L 2200/0415* (2013.01); *C10L 2200/0461* (2013.01)

(58) Field of Classification Search
CPC ... C10B 53/07; C10L 1/00; C10L 1/04; C10L 1/14; C10L 1/1608; C10L 1/1616;
(Continued)

(56) References Cited

U.S. PATENT DOCUMENTS

2012/0289440 A1 11/2012 Pollard et al.
2013/0174476 A1* 7/2013 Ramirez Corredores ..... C10G 3/50 44/307

(Continued)

FOREIGN PATENT DOCUMENTS

CS 251525 B1 * 7/1987
WO 2012057988 A1 5/2012
WO WO-2020247515 A1 * 12/2020 ..... C10L 1/1616

OTHER PUBLICATIONS

English-language machine translation of CS 251525 B1 (Year: 1987).*

(Continued)

*Primary Examiner* — James C Goloboy
(74) *Attorney, Agent, or Firm* — John M. Desper; Eckert Seamans Cherin & Mellott, LLC

(57) ABSTRACT

Provided is a crude oil additive comprising a pyrolysis oil fraction. In some embodiments, the crude oil additive further comprises a dispersant. Also provided are methods of preparing the crude oil additive as well as methods for reducing the viscosity of crude oil and methods for increasing the API gravity of crude oil.

24 Claims, 3 Drawing Sheets

(58) Field of Classification Search
CPC ..... C10L 1/1817; C10L 10/00; C10L 10/18; C10L 2200/0415; C10L 2200/0461; F17D 1/17
See application file for complete search history.

(56) References Cited

U.S. PATENT DOCUMENTS

2019/0375991 A1 12/2019 Monaco et al.
2020/0377809 A1 12/2020 Swain et al.

OTHER PUBLICATIONS

Gerardo Martinez Narro et al., Viscosity Reduction of Heavy Crude Oil By Dilution With Hydrocarbons Obtained via Chemical Recycling of Plastic Wastes, Petroleum Science and Technology (Jun. 18, 2019), 37(12):1347-1354.
Phong Hai Vu et al., Effective Use of Orinoco Tar as Alternative Fuel for Diesel Engines (Orinoco Tar Quality Improvement of WPD), Society of Automative Engineers, Inc. (Jul. 9, 2002).
Gerardo Martinez-Narro et al., Heavy Crude Oil Viscosity Reduction by Dilution With Hydrocarbons Obtained via Pyrolysis of Polypropylene and Polystyrene, Petroleum Science and Technology (Jul. 27, 2020), 38(8):651-658.
Santos et al., An Overview of Heavy Oil Properties and Its Recovery and Transportation Methods, Brazilian Journal of Chemical Engineering (2014), 31(3):571-590.
Dehaghani and Badizad, Experimental Study of Iranian Heavy Crude Oil Viscosity Reduction by Diluting With Heptane, Methanol, Toluene, Gas Condensate and Naphtha, Petroleum 2 (2016):415-424.
Fakher et al., Critical Review of Asphaltene Properties and Factors Impacting Its Stability in Crude Oil, Journal of Petroleum Exploration and Production Technology (2020), 10(1):1183-1200.

* cited by examiner

ADDITIVES AND METHODS FOR IMPROVING FLOW PROPERTIES OF CRUDE OIL

CROSS-REFERENCE TO RELATED APPLICATIONS

The instant application is a U.S. National Stage Application under 35 U.S.C. § 371 of International Patent Application No. PCT/US2022/012071, filed on Jan. 12, 2022, entitled "ADDITIVES AND METHODS FOR IMPROVING FLOW PROPERTIES OF CRUDE OIL", which is entitled to priority under 35 U.S.C. § 119(e) to U.S. Provisional Application No. 63/136,360, filed Jan. 12, 2021, each of which is hereby incorporated by reference in its entirety.

FIELD OF THE INVENTION

Additives and methods for improving the flow properties of crude oil are provided.

BACKGROUND OF THE INVENTION

The current exploration of crude oil sources has expanded to investigating extraction from sources that were not considered economically viable in the past. Crude oil from most of these sources is generally of high viscosity and density, having low API gravity. It is well established that, in order to be able to pump such oils from the well, transport it, and process it further, it is necessary to alter its flow properties. Approaches include heating, dilution with solvents (n-heptane, toluene, xylene, naphtha), partial upgrading, water lubrication, core annular flow, and crude oil-in-water emulsions. (Santos, R. G., W. Loh, A. C. Bannwart, and O. V. Trevisan. *Brazilian Journal of Chemical Engineering* Vol. 31 No. 3 (2014) p. 571-590). Naphtha is a petroleum fraction which is mainly composed of paraffinic components and is widely used as a diluent that works to break up the asphaltenes and paraffinic components that increase the viscosity of the crude oil. (Dehaghani, A. H. S. and M. H. Badizad. *Petroleum* Vol. 2 (2016) p. 415-424; Argillier, J.-F., I. Hénaut, P. Gateau, and J.-P. Héraud. *SPE/PS-CIWCHOA International Thermal Operations and Heavy Oil Symposium* 97763. PS2005-343. (2005) 7p). It is notable that paraffinic naphtha is used to modify the viscosity of heavy crudes as well as that of aromatics, both of which are nonpolar. In fact, alkanes, including pentane and heptane, are used to test for polar compounds in crude oil by precipitating them as C5 and C7 insolubles.

Commercial solvents, such as naphtha, xylene, or toluene have typically been used to improve the flow characteristics of heavy crude oils. These function to lower the viscosity as dispersants. Recently, U.S. application Ser. No. 16/892,135 was published on Dec. 3, 2020 as Publication No. US 2020/0377809 on behalf of EWO Solutions LLC, claiming priority to U.S. Provisional Patent Application Nos. 62/856,499, 62/856,507 and 62/856,515 which were filed on Jun. 3, 2019. On Dec. 10, 2020, International Publication WO 2020/247515 was published on behalf of EWO Solutions LLC, also claiming priority to U.S. Provisional Patent Application Nos. 62/856,499, 62/856,507 and 62/856,515 which were filed on Jun. 3, 2019. The publications disclose the concept of adding pyrolysis oil to naphtha in order to reduce the amount of naphtha necessary to achieve an equivalent viscosity decrease and increase in API gravity compared to when naphtha is used alone. In particular, they have identified that pyrolysis oil can be used in combination with naphtha to form what they have called Ultranaphtha®. S. Fakher et al. described the structures and properties of various types of asphaltenes and how they impact the viscosity of crude oils (S. Fakher et al., "Critical Review of Asphaltene Properties and Factors Impacting its Stability in Crude Oil," Journal of Petroleum Exploration and Production Technology, Springer, December 2019).

There remains a need for novel and cost-effective methods for improving the flow properties of crude oil.

SUMMARY

Provided is a crude oil additive comprising a pyrolysis oil fraction.

In some embodiments, the additive further comprises a dispersant. In some embodiments, the dispersant is a solvent. In some embodiments, the solvent is an aromatic solvent, an aliphatic solvent, or a combination thereof. In further embodiments, the solvent is selected from the group consisting of a naphtha, xylene, toluene, benzene, n-heptane, and styrene. In yet further embodiments, the solvent is a naphtha.

In some embodiments, the ratio of pyrolysis oil fraction to dispersant is from about 1:35 to about 4:1. In some embodiments, the ratio of pyrolysis oil fraction to dispersant is from about 1:35 to about 2:1. In further embodiments, the ratio of pyrolysis oil fraction to dispersant is from about 1:35 to about 1:20. In yet further embodiments, the ratio of pyrolysis oil fraction to dispersant is from about 1:35 to about 1:24. In yet further embodiments, the ratio of pyrolysis oil fraction to dispersant is about 1:24.

In some embodiments, the additive does not comprise a dispersant.

In some embodiments, the pyrolysis oil fraction is present in the additive in a concentration of at least 0.1%, 0.2%, 0.3%, 0.4%, 0.5%, 0.6%, 0.7%, 0.8%, 0.9%, 1%, 2%, 3%, 4%, 5%, 6%, 7%, 8%, 9%, 10%, 20%, 30%, 40%, 50%, 60%, 70%, 80%, or 90% (v/v). In some embodiments, the pyrolysis oil fraction is present in the additive in a concentration of from about 0.1% to about 10% (v/v). In some embodiments, the pyrolysis oil fraction is present in the additive in a concentration of from about 0.1% to about 5% (v/v). In some embodiments, the pyrolysis oil fraction is present in the additive in a concentration of from about 0.1% to about 1% (v/v). In further embodiments, the pyrolysis oil fraction is present in the additive in a concentration of at least 91%, 92%, 93%, 94%, 95%, 96%, 97%, 98%, or 99% (v/v).

In some embodiments, the additive is substantially free of unfractionated pyrolysis oil. In some embodiments, the percentage of unfractionated pyrolysis oil in the additive is less than 10%, 9%, 8%, 7%, 6%, 5%, 4%, 3%, 2%, or 1% (v/v). In further embodiments, the percentage of unfractionated pyrolysis oil in the additive is less than 0.9%, 0.8%, 0.7%, 0.6%, 0.5%, 0.4%, 0.3%, 0.2%, 0.1%, 0.09%, 0.08%, 0.07%, 0.06%, 0.05%, 0.04%, 0.03%, 0.02%, or 0.01% (v/v).

In some embodiments, the additive does not comprise unfractionated pyrolysis oil.

In some embodiments, the pyrolysis oil fraction is a pyrolysis sludge, a steam distillate top, a steam distillate bottom, a light distillate, a heavy distillate, a polar fraction, an aromatic fraction, an insoluble fraction, or combinations thereof. In further embodiments, the pyrolysis oil fraction is a pyrolysis sludge. In some embodiments, the percentage of terpene in the pyrolysis oil fraction is less than 1%, 0.9%, 0.8%, 0.7%, 0.6%, 0.5%, 0.4%, 0.3%, 0.2%, 0.1%, 0.09%, 0.08%, 0.07%, 0.06%, 0.05%, 0.04%, 0.03%, or 0.02% (v/v). In further embodiments, the percentage of terpene in the pyrolysis oil fraction is less than 1% (v/v). In some embodiments, the percentage of terpene in the pyrolysis oil fraction is less than 0.01%, 0.009%, 0.008%, 0.007%, 0.006%, 0.005%, 0.004%, 0.003%, 0.002%, or 0.001% (v/v). In further embodiments, the percentage of terpene in the pyrolysis oil fraction is less than 0.001% (v/v). In some embodiments, the terpene is limonene, cymene, or combinations thereof. In some embodiments, the pyrolysis oil fraction does not comprise limonene. In some embodiments, the pyrolysis oil fraction does not comprise cymene.

In some embodiments, the crude oil is a heavy crude oil.

In some embodiments, the crude oil additive reduces the viscosity of crude oil.

In some embodiments, the crude oil additive increases the American Petroleum Institute (API) gravity of crude oil.

Provided is a method of preparing the crude oil additive of any one of the previous embodiments, comprising combining a pyrolysis oil fraction; and a dispersant.

In some embodiments, the pyrolysis oil fraction is a pyrolysis sludge, a steam distillate top, a steam distillate bottom, a light distillate, a heavy distillate, a polar fraction, an aromatic fraction, or an insoluble fraction.

In some embodiments, the dispersant is a solvent. In some embodiments, the solvent is an aromatic solvent, an aliphatic solvent, or a combination thereof. In further embodiments, the solvent is selected from the group consisting of a naphtha, xylene, toluene, benzene, n-heptane, and styrene. In yet further embodiments, the solvent is a naphtha.

In some embodiments, the crude oil is a heavy crude oil.

Provided is a method of reducing the viscosity of crude oil comprising adding the crude oil additive of any one of the preceding embodiments to crude oil, thereby reducing the viscosity of the crude oil.

In some embodiments, the additive is added to the crude oil at a concentration of from about 5% to about 30% (v/v). In some embodiments, the additive is added to the crude oil at a concentration of from about 15% to about 30% (v/v). In further embodiments, the additive is added to the crude oil at a concentration of about 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29%, or 30% (v/v).

In some embodiments, the crude oil is a heavy crude oil.

Provided is a method of increasing the API gravity of a crude oil comprising adding the crude oil additive of any one of the preceding embodiments to crude oil, thereby increasing the API gravity of the crude oil.

In some embodiments, the additive is added to the crude oil at a concentration of from about 5% to about 30% (v/v). In some embodiments, the additive is added to the crude oil at a concentration of from about 15% to about 30% (v/v). In further embodiments, the additive is added to the crude oil at a concentration of about 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29%, or 30% (v/v).

In some embodiments, the crude oil is a heavy crude oil.

DETAILED DESCRIPTION

Figure 1:
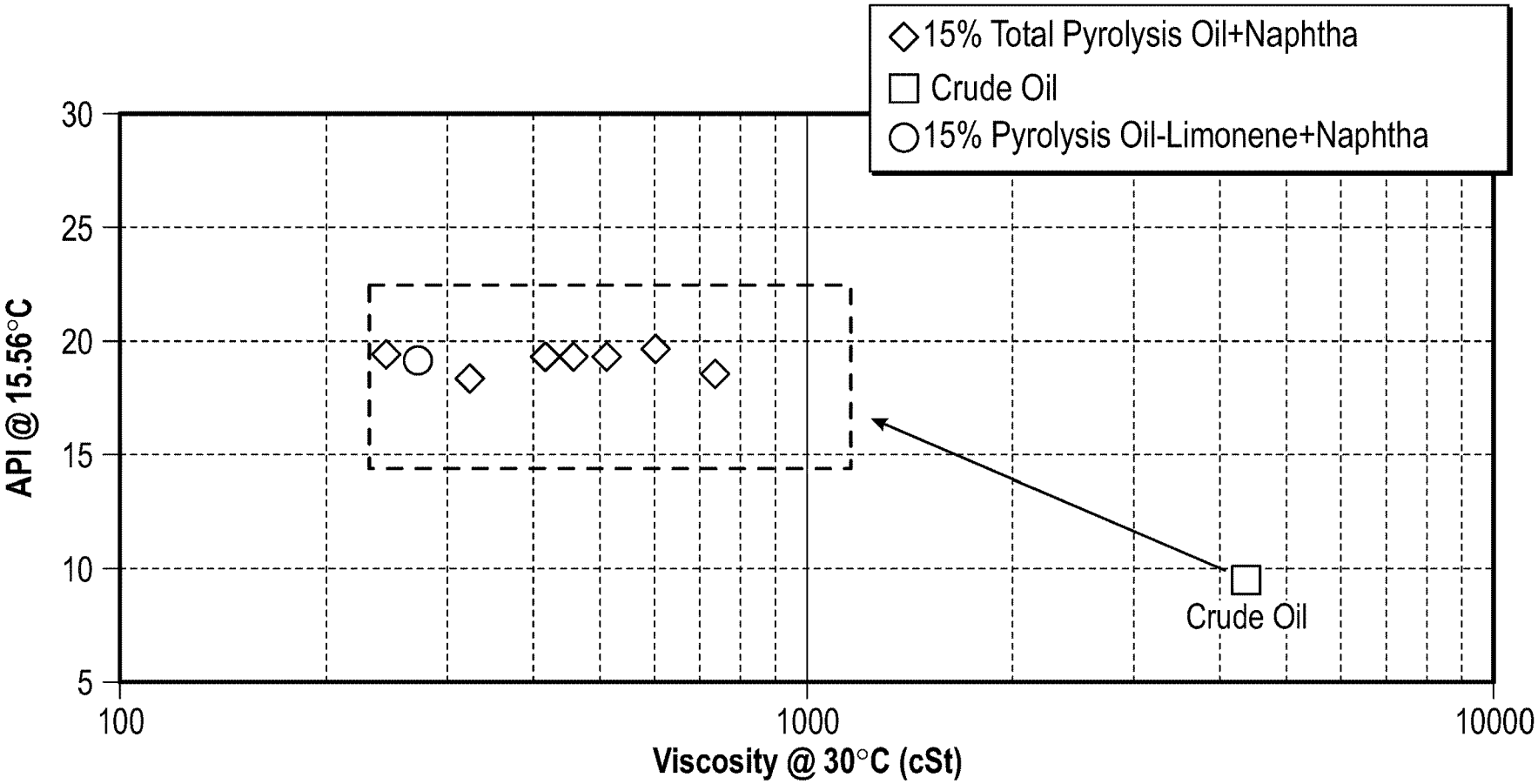
FIG. 1 is a graph that shows a comparison between a crude oil additive consisting of [naphtha plus pyrolysis oil (diamonds)] and a crude oil additive consisting of [naphtha plus pyrolysis oil minus Limonene (circles)] in Viscosity—API Gravity Space. The graph shows the similar performance of the two reagents.

Unless defined otherwise, all technical and scientific terms used herein have the same meaning as is commonly understood by one of skill in the art to which this invention belongs. All publications and patents referred to herein are incorporated by reference.

As used herein, the articles "a" and "an" may refer to one or to more than one (e.g. to at least one) of the grammatical object of the article.

As used herein, "about" may generally refer to an acceptable degree of error for the quantity measured given the nature or precision of the measurements. Example degrees of error are within 5% of a given value or range of values.

Embodiments described herein as "comprising" one or more features may also be considered as disclosure of the corresponding embodiments "consisting of" and/or "consisting essentially of" such features.

Concentrations, amounts, volumes, percentages and other numerical values may be presented herein in a range format. It is also to be understood that such range format is used merely for convenience and brevity and should be interpreted flexibly to include not only the numerical values explicitly recited as the limits of the range but also to include all the individual numerical values or sub-ranges encompassed within that range as if each numerical value and sub-range is explicitly recited.

As used herein, the term "pyrolysis sludge" means a fraction of material that falls out of solution from pyrolysis oil and is separated from the oil by centrifugation, filtration, sedimentation or by any other means.

As used herein, the term "polar fraction" means a fraction of material containing charged or otherwise polar compound that either falls out of solution or is caused to fall out of solution from pyrolysis oil by adding compounds that change the nature of the oil in such a manner that polar compounds are not soluble and are separated from the oil by centrifugation, filtration, sedimentation, electro-kinetic, or by any other means.

As used herein, the term "steam distillate top" means a light or top fraction of pyrolysis oil collected by heating pyrolysis oil in the presence of water or steam, which fractionates primarily based on vapor pressure.

As used herein, the term "steam distillate bottom" means a heavy or bottom fraction of pyrolysis oil collected by heating pyrolysis oil in the presence of water or steam, which fractionates primarily based on vapor pressure.

As used herein, the term "light distillate" means a light or top fraction collected by a batch, continuous, flash or any other distillation process, which separates fractions based primarily on boiling points.

As used herein, the term "heavy distillate" means a heavy or bottom fraction collected by a batch, continuous, flash or any other distillation process, which separates fractions based primarily on boiling points.

In some embodiments of any of the methods, additives, formulations or compositions described herein, a range is intended to comprise every integer or fraction or value within the range.

Methods for Processing Pyrolysis Oil

Methods for processing pyrolysis oil are described, for example, in U.S. Pat. Nos. 10,577,540; 10,596,487; 10,767,115; and 9,920,262, each of which is incorporated by reference herein in its entirety.

U.S. Pat. No. 9,920,262 describes methods for separation of pyrolysis oils comprising an initial separation which establishes a lighter fraction and a heavier fraction. The lighter fraction is subjected to plate distillation and the heavier fraction is subjected to the removal of sulfur and nitrogen compounds therefrom. In some embodiments, the starting material is vehicular tires.

U.S. Pat. No. 10,577,540 describes methods for separation of pyrolysis oils to produce a light fraction containing high value products, such as limonene, and a heavy fraction for use as a fuel oil or for further processing. This is followed by a second phase subjecting the lighter fraction to fractional distillation. The heavier fraction may be subjected to an extraction to produce an effective solvent, fuel oil, or a feedstock for other chemical processes. In some embodiments, the initial separation of the pyrolysis oil involves a steam distillation.

U.S. Pat. Nos. 10,596,487 and 10,767,115 describe methods for converting the black color of pyrolysis oil derived from thermal treatment of vehicle tires or other waste materials to a lighter more yellow color. They also describe methods for removing polar compounds from pyrolysis oil and reducing the polyaromatic hydrocarbons (PAH) levels in the pyrolysis oils.

Crude Oil Additive

Provided is a crude oil additive comprising a pyrolysis oil fraction. In some embodiments, the crude oil additive consists of a pyrolysis oil fraction. In some embodiments, the crude oil additive consists essentially of a pyrolysis oil fraction.

In some embodiments, the additive comprises a dispersant. In some embodiments, the additive consists of a pyrolysis oil fraction and a dispersant. In some embodiments, the additive consists essentially of a pyrolysis oil fraction and a dispersant.

In some embodiments, the pyrolysis oil fraction is a pyrolysis sludge, a steam distillate top, a steam distillate bottom, a light distillate, a heavy distillate, a polar fraction, an aromatic fraction, an insoluble fraction, or combinations thereof. In further embodiments, the pyrolysis oil fraction is a pyrolysis sludge. In some embodiments, the percentage of terpene in the pyrolysis oil fraction is less than 1%, 0.9%, 0.8%, 0.7%, 0.6%, 0.5%, 0.4%, 0.3%, 0.2%, 0.1%, 0.09%, 0.08%, 0.07%, 0.06%, 0.05%, 0.04%, 0.03%, or 0.02% (v/v). In further embodiments, the percentage of terpene in the pyrolysis oil fraction is less than 1% (v/v). In some embodiments, the percentage of terpene in the pyrolysis oil fraction is less than 0.01%, 0.009%, 0.008%, 0.007%, 0.006%, 0.005%, 0.004%, 0.003%, 0.002%, or 0.001% (v/v). In further embodiments, the percentage of terpene in the pyrolysis oil fraction is less than 0.001% (v/v). In some embodiments, the terpene is limonene, cymene, or combinations thereof. In some embodiments, the pyrolysis oil fraction does not comprise limonene. In some embodiments, the pyrolysis oil fraction does not comprise cymene.

In some embodiments, the dispersant is an aromatic solvent or n-heptane. In further embodiments, the aromatic solvent is selected from the group consisting of naphtha, xylene, toluene, benzene, and styrene. In yet further embodiments, the solvent is naphtha.

In some embodiments, the ratio of pyrolysis oil fraction to dispersant is from about 1:35 to about 4:1. In some embodiments, the ratio of pyrolysis oil fraction to dispersant is from about 1:35 to about 2:1. In further embodiments, the ratio of pyrolysis oil fraction to dispersant is from about 1:35 to about 1:20. In yet further embodiments, the ratio of pyrolysis oil fraction to dispersant is about 1:35 to about 1:24. In yet further embodiments, the ratio of pyrolysis oil fraction to dispersant is about 1:24.

In some embodiments, the additive does not comprise a dispersant.

In some embodiments, the pyrolysis oil fraction is present in the additive in a concentration of at least 0.1%, 0.2%, 0.3%, 0.4%, 0.5%, 0.6%, 0.7%, 0.8%, 0.9%, 1%, 2%, 3%, 4%, 5%, 6%, 7%, 8%, 9%, 10%, 20%, 30%, 40%, 50%, 60%, 70%, 80%, or 90% (v/v). In some embodiments, the pyrolysis oil fraction is present in the additive in a concentration of from about 0.1% to about 10% (v/v). In some embodiments, the pyrolysis oil fraction is present in the additive in a concentration of from about 0.1% to about 5% (v/v). In some embodiments, the pyrolysis oil fraction is present in the additive in a concentration of from about 0.1% to about 1% (v/v). In further embodiments, the pyrolysis oil fraction is present in the additive in a concentration of at least 91%, 92%, 93%, 94%, 95%, 96%, 97%, 98%, or 99% (v/v).

In some embodiments, the additive is substantially free of unfractionated pyrolysis oil. In some embodiments, the percentage of unfractionated pyrolysis oil in the additive is less than 10%, 9%, 8%, 7%, 6%, 5%, 4%, 3%, 2%, or 1% (v/v). In further embodiments, the percentage of unfractionated pyrolysis oil in the additive is less than 0.9%, 0.8%, 0.7%, 0.6%, 0.5%, 0.4%, 0.3%, 0.2%, 0.1%, 0.09%, 0.08%, 0.07%, 0.06%, 0.05%, 0.04%, 0.03%, 0.02%, or 0.01% (v/v).

In some embodiments, the additive does not comprise unfractionated pyrolysis oil.

In some embodiments, the crude oil is a heavy crude oil.

Methods for Reducing the Viscosity or Raising the API Gravity of Crude Oil

Pyrolysis oil fractions are a complex mixture of chemicals that have demonstrated herein the ability to reduce the viscosity and/or raise the API gravity of crude oils when added alone or with a dispersant to crude oil. In some embodiments, the crude oil is a heavy crude oil.

In some embodiments, the dispersant is a solvent. In some embodiments, the solvent is an aromatic solvent, an aliphatic solvent, or a combination thereof. In further embodiments, the solvent is selected from the group consisting of a naphtha, xylene, toluene, benzene, n-heptane, and styrene. In yet further embodiments, the solvent is a naphtha.

The addition of a pyrolysis oil fraction to crude oil simultaneously reduces cost, increases oil delivery capacity by reducing the volume of additives necessary to improve flow, and simplifies processing by reducing the amount of dispersant that needs to be reclaimed downstream. The beneficial use of a pyrolysis oil fraction also provides an economically viable opportunity to address one of the largest environmental hazards facing human society around the globe. The present invention describes a method to tailor the formulation by utilizing fractions of pyrolysis oil that contain the principal components responsible for alterations to crude oil viscosity and API gravity. This allows producers to optimize flow properties on a location-by-location, deposit-by-deposit, or well-by-well basis as necessary. In such a manner, the value of the pyrolysis oil has been increased by separating components that have a greater value to be used to make value-added products while not changing the viscosity modifying properties of the remaining fraction. Additionally, low value fractions have been shown to be usefully employed to formulate viscosity/API gravity modifiers. Thus this raises the overall value of pyrolysis oil while still producing viscosity/API gravity modifiers.

Herein are described the beneficial use as viscosity and API gravity modifiers of fractions of pyrolysis oil, including, but not limited to: steam distillate tops, steam distillate bottoms, light and heavy distillates, polar and aromatic fractions, and insoluble fractions isolated from pyrolysis oil. The fractions can be utilized either as produced or added with a dispersant. In some embodiments, a dispersant may comprise an aromatic solvent, a non-aromatic solvent, or combinations thereof. Dispersants include but are not limited to solvents, for example naphtha, xylene, toluene, benzene, n-heptane or styrene.

Various asphaltenes may impact the viscosity of crude oils. As long as the oil being formed is not disturbed, the asphaltene will remain stable. However, once any chemical or mechanical disturbance occurs in the oil, the asphaltene will begin to precipitate from the oil solution and the viscosity and/or density of the oil will increase. As oil is brought to the surface, the pressure and temperature are disturbed and dissolved gasses are released. As the balance of materials change, charged asphaltenes eventually precipitate due to an electrokinetic effect. Precipitation of asphaltenes adversely effects the flow properties of the crude oil.

The precipitated asphaltenes are generally in a colloid form. The colloid can be broken by addition of polar compounds, such as those found in pyrolysis oil, that attach to the charged components of the precipitating asphaltenes and break the colloid. This reverses the adverse effects. In addition, by adding solvents, such as naphtha or xylene (or other aromatics) the oil can be further 'thinned out', decreasing viscosity. This combination of polar compounds and diluting solvents become the viscosity modifier.

Unexpectedly, as described herewith, a pyrolysis oil fraction may replace unfractionated pyrolysis oil as a viscosity modifier. By fractionating pyrolysis oil its balance of polar and diluent properties can be selectively tailored for the best outcome. In addition, valuable fractions (for example, but not limited to, limonene) can be removed without affecting the modifier properties of the remaining oil.

EXAMPLES

Example 1: Removal of Terpenes (Limonene) does not Significantly Affect Performance of Pyrolysis Oil The removal of valuable components from pyrolysis oil, such as terpenes, does not alter the pyrolysis oil's effectiveness as a viscosity and API gravity crude oil modifier. The square marker on FIG. 1 represents data from unmodified crude oil while the circular marker represents crude oil modified with naphtha plus a fractionated pyrolysis oil in which a limonene-rich fraction has been removed (formulation 7 in Table 1). The graph demonstrates that the same level of modification can be achieved with this altered fraction as with naphtha plus an unfractionated pyrolysis oil (diamond markers, corresponding to formulations 1-6 in Table 1).

The components removed from the altered pyrolysis oil fraction can be sold to improve the over-all value of the pyrolysis oil.

Percentages in Table 1 are expressed as % (v/v).

TABLE 1

| Formulations | | | | | | | | |
|---|---|---|---|---|---|---|---|---|
| Formulation | Pyrolysis Oil or Pyrolysis Oil Fraction | % Crude Oil in Formulation | % Total Additive in Formulation | Ratio of Pyrolysis Oil or Pyrolysis Oil Fraction to Naphtha | % Naphtha in Formulation | % Pyrolysis Oil or Pyrolysis Oil Fraction in Formulation | Viscosity at 30° C. | API at 15.56° C. |
| 1 | Pyrolysis Oil A | 85.00% | 15.00% | 1:35 | 14.58% | 0.42% | 415.20 | 19.30 |
| 2 | Pyrolysis Oil A | 85.00% | 15.00% | 1:30 | 14.52% | 0.48% | 455.00 | 19.30 |
| 3 | Pyrolysis Oil A | 85.00% | 15.00% | 1:24 | 14.40% | 0.60% | 243.80 | 19.39 |
| 4 | Pyrolysis Oil A | 85.00% | 15.00% | 1:20 | 14.29% | 0.71% | 602.30 | 19.60 |
| 5 | Pyrolysis Oil A | 85.00% | 15.00% | 1:2 | 10.00% | 5.00% | 510.00 | 19.32 |
| 6 | Pyrolysis Oil A | 85.00% | 15.00% | 2:1 | 5.00% | 10.00% | 734.30 | 18.54 |
| 7 | Pyrolysis Oil A minus limonene cut | 85.00% | 15.00% | 1:24 | 14.40% | 0.60% | 272.10 | 19.13 |
| 8 | Pyrolysis Oil A | 85.00% | 15.00% | | 0.00% | 15.00% | 1219.70 | 17.59 |
| 9 | Pyrolysis Oil A | 80.00% | 20.00% | 1:35 | 19.44% | 0.56% | 305.50 | 19.80 |

TABLE 1-continued

| Formulations | | | | | | | | |
|---|---|---|---|---|---|---|---|---|
| Formulation | Pyrolysis Oil or Pyrolysis Oil Fraction | % Crude Oil in Formulation | % Total Additive in Formulation | Ratio of Pyrolysis Oil or Pyrolysis Oil Fraction to Naphtha | % Naphtha in Formulation | % Pyrolysis Oil or Pyrolysis Oil Fraction in Formulation | Viscosity at 30° C. | API at 15.56° C. |
| 10 | Pyrolysis Oil A | 80.00% | 20.00% | 1:30 | 19.35% | 0.65% | 389.30 | 20.10 |
| 11 | Pyrolysis Oil A | 80.00% | 20.00% | 1:24 | 19.20% | 0.80% | 211.00 | 21.20 |
| 12 | Pyrolysis Oil A | 80.00% | 20.00% | 1:20 | 19.05% | 0.95% | 543.00 | 20.80 |
| 13 | Pyrolysis Oil A | 75.00% | 25.00% | 1:35 | 24.31% | 0.69% | 204.50 | 20.90 |
| 14 | Pyrolysis Oil A | 75.00% | 25.00% | 1:30 | 24.19% | 0.81% | 245.00 | 21.20 |
| 15 | Pyrolysis Oil A | 75.00% | 25.00% | 1:24 | 24.00% | 1.00% | 121.80 | 22.60 |
| 16 | Pyrolysis Oil A | 75.00% | 25.00% | 1:20 | 23.81% | 1.19% | 346.50 | 21.50 |
| 17 | Pyrolysis Oil A | 70.00% | 30.00% | 1:35 | 29.17% | 0.83% | 141.30 | 22.00 |
| 18 | Pyrolysis Oil A | 70.00% | 30.00% | 1:30 | 29.03% | 0.97% | 148.60 | 22.40 |
| 19 | Pyrolysis Oil A | 70.00% | 30.00% | 1:24 | 28.80% | 1.20% | 64.70 | 24.50 |
| 20 | Pyrolysis Oil A | 70.00% | 30.00% | 1:20 | 28.57% | 1.43% | 185.80 | 22.30 |
| 21 | Pyrolysis Oil A Steam Bottoms | 85.00% | 15.00% | 1:24 | 14.40% | 0.60% | 971.80 | 19.26 |
| 22 | Pyrolysis Oil A Steam Bottoms | 85.00% | 15.00% | 1:14 | 14.00% | 1.00% | 486.50 | 20.45 |
| 23 | Pyrolysis Oil A Steam Bottoms | 85.00% | 15.00% | 1:4 | 12.00% | 3.00% | 522.90 | 19.90 |
| 24 | Pyrolysis Oil A Steam Tops | 85.00% | 15.00% | | 0.00% | 15.00% | 323.10 | 17.42 |
| 25 | Pyrolysis Oil A Steam Tops | 85.00% | 15.00% | | 0.00% | 15.00% | 403.88 | 17.07 |
| 26 | Pyrolysis Oil Sludge | 85.00% | 15.00% | 4:1 | 3.00% | 12.00% | 792.00 | 20.39 |
| 27 | Pyrolysis Oil Sludge | 85.00% | 15.00% | 3:2 | 6.00% | 9.00% | 915.10 | 18.80 |
| 28 | Filtered Pyrolysis Oil Sludge | 85.00% | 15.00% | | 9.00% | 6.00% | 1085.00 | 17.98 |
| 29 | Filtered Pyrolysis Oil Sludge + Pyrolysis Oil A | 85.00% | 15.00% | | 11.40% | 3.00% Sludge + 0.60% Pyrolysis Oil A | 1073.10 | 18.33 |
| 30 | Distillation Top | 85.00% | 15.00% | | 0.00% | 15.00% | 231.70 | 18.65 |
| 31 | Distillation Top | 90.00% | 10.00% | | 0.00% | 10.00% | 789.90 | 16.70 |
| 32 | Distillation Top | 95.00% | 5.00% | | 0.00% | 5.00% | 2433.00 | 16.50 |
| 33 | None (i.e., naphtha only) | 85.00% | 15.00% | | 15.00% | 0.00% | | 17.10 |
| 34 | None (i.e., naphtha only) | 80.00% | 20.00% | | 20.00% | 0.00% | | 18.00 |
| 35 | None (i.e., naphtha only) | 75.00% | 25.00% | | 25.00% | 0.00% | | 19.20 |

TABLE 1-continued

| Formulations | | | | | | | | |
|---|---|---|---|---|---|---|---|---|
| Formulation | Pyrolysis Oil or Pyrolysis Oil Fraction | % Crude Oil in Formulation | % Total Additive in Formulation | Ratio of Pyrolysis Oil or Pyrolysis Oil Fraction to Naphtha | % Naphtha in Formulation | % Pyrolysis Oil or Pyrolysis Oil Fraction in Formulation | Viscosity at 30° C. | API at 15.56° C. |
| 36 | None (i.e., naphtha only) | 70.00% | 30.00% | | 30.00% | 0.00% | | 20.60 |
| 37 | Pyrolysis Oil B | 85.00% | 15.00% | | 14.40% | 0.60% | 365.70 | 20.09 |
| 38 | Pyrolysis Oil B Steam Tops | 85.00% | 15.00% | | 0.00% | 15.00% | 374.80 | 16.95 |
| 39 | Pyrolysis Oil B Steam Bottoms | 85.00% | 15.00% | | 14.40% | 0.60% | 330.90 | 20.11 |
| 40 | Pyrolysis Oil C - Heavy | 85.00% | 15.00% | | 14.40% | 0.60% | 495.50 | 19.20 |
| 41 | Pyrolysis Oil C-Light | 0.00% | 15.00% | | 0.00% | 15.00% | 296.90 | 18.40 |
| 42 | None (i.e. Crude Oil Control) | 100.00% | 0.00% | | 0.00% | 0.00% | 4339.70 | 9.50 |

Example 2: Pyrolysis Sludge

Figure 2:
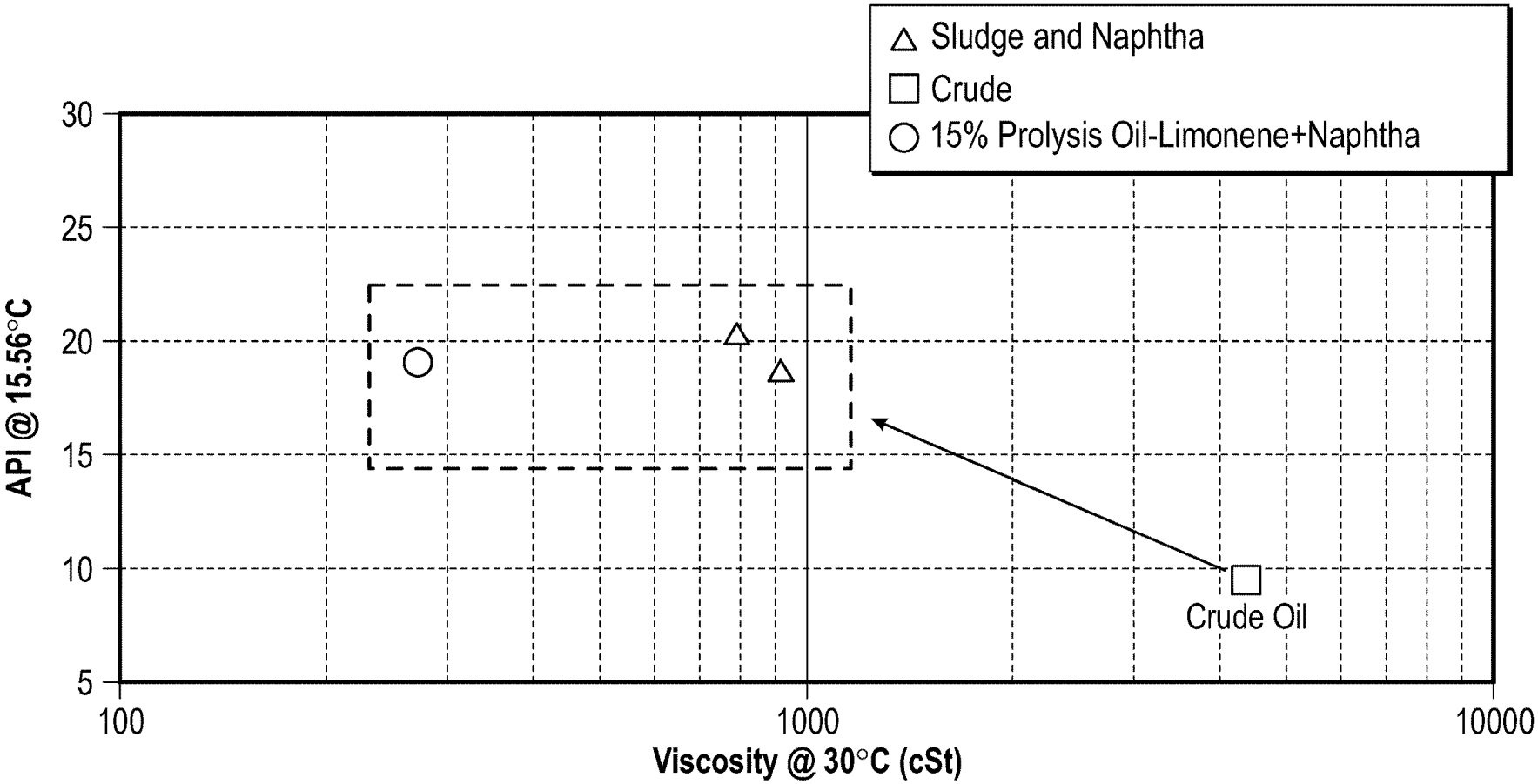
FIG. 2 is a graph that shows that low-value pyrolysis oil fraction (pyrolysis sludge) plus naphtha (triangles) has the capacity to modify crude oil into an acceptable viscosity range. The circle represents crude oil modified with naphtha plus a fractionated pyrolysis oil in which a limonene-rich fraction has been removed.

The current invention teaches the use of fractions from pyrolysis oil for formulating crude oil additives that are viscosity/API gravity modifiers. FIG. 2 shows the use of sludge fractionated by the pyrolysis process as a waste material. The figure shows that low value pyrolysis sludge when combined with naphtha has the capacity to modify the viscosity of crude oil and bring it into an acceptable range.

The triangular marker in FIG. 2 represents crude oil modified with naphtha plus a fractionated pyrolysis oil sludge (formulations 2 and 3 in Table 2). The circular marker in FIG. 2 represents crude oil modified with naphtha plus fractionated pyrolysis oil in which a limonene-rich fraction has been removed (formulation 4 in Table 2).

Percentages in Table 2 are expressed as % (v/v).

TABLE 2

| Formulations | | | | | | | | |
|---|---|---|---|---|---|---|---|---|
| Formulation | Pyrolysis Oil or Pyrolysis Oil Fraction | % Crude Oil in Formulation | % Total additive in Formulation | Ratio of Pyrolysis Oil or Pyrolysis Oil Fraction to Naphtha | % Naphtha in Formulation | % Pyrolysis Oil or Pyrolysis Oil Fraction in Formulation | Viscosity at 30° C. | API at 15.56° C. |
| 1 | None (i.e. Crude Oil Control) | 100.00% | 0.00% | | 0.00% | 0.00% | 4339.70 | 0.50 |
| 2 | Sludge | 85.00% | 15.00% | 4:1 | 3.00% | 12.00% | 792.00 | 20.39 |
| 3 | Sludge | 85.00% | 15.00% | 3:2 | 6.00% | 9.00% | 915.10 | 18.80 |
| 4 | Pyrolysis Oil A minus limonene cut | 85.00% | 15.00% | 1:24 | 14.40% | 0.60% | 272.10 | 19.13 |

One reason this material is a sludge is because of its high polarity. It consists of oxygen, sulfur, and nitrogen-containing compounds that are insoluble in the pyrolysis oil. Its polarity causes it to interact with polar asphaltenes in the crude oil. This interaction breaks down asphaltene colloidal precipitates. Adding a dispersant, such as naphtha or xylene make this low value fraction into an effective crude oil modifier.

Example 3: Customized Additives as Viscosity Modifiers

Figure 3:
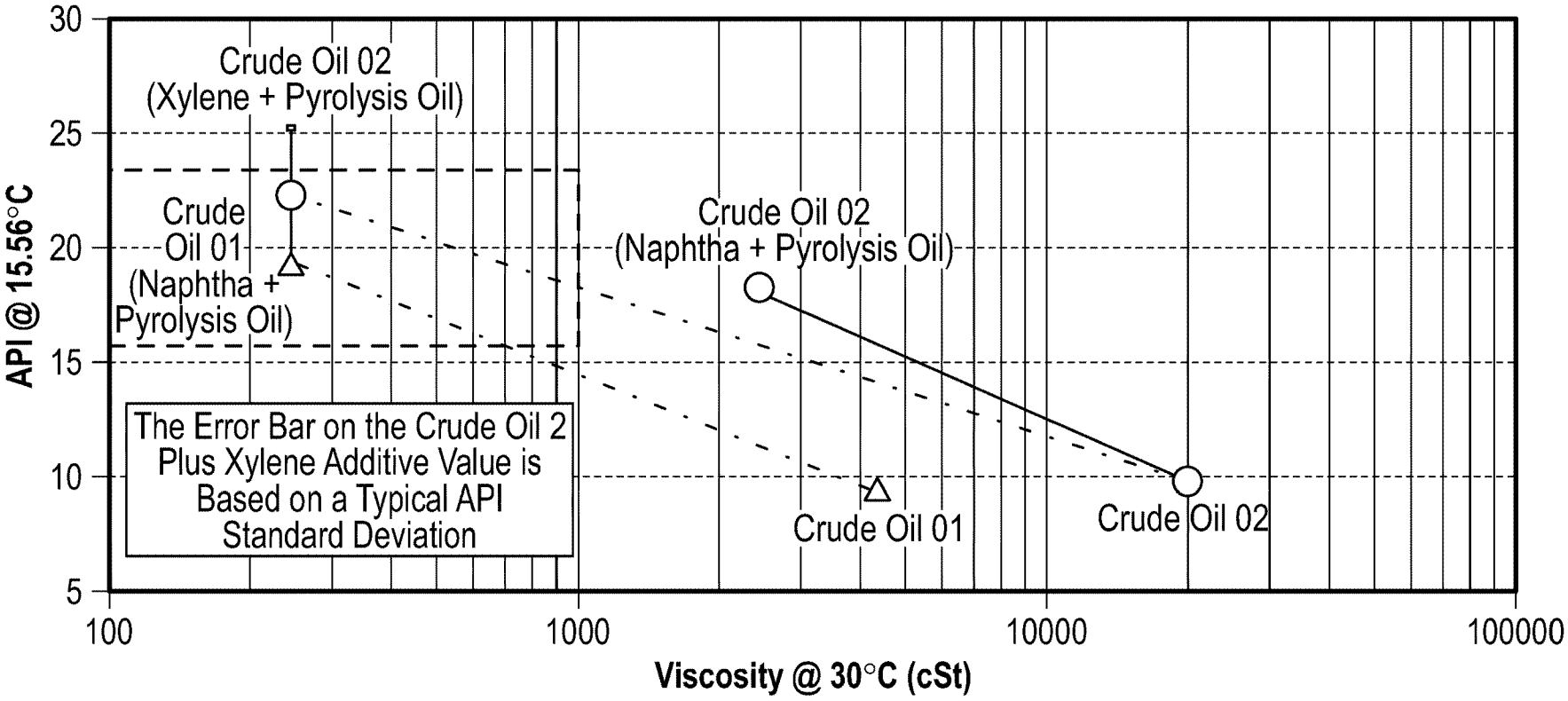
FIG. 3 is a graph that shows modification of two crude oils with customized crude oil additives. The viscosity and API gravity were measured for Crude Oil 01 and and for Crude Oil 01 (Naptha+Pyrolysis Oil additive). The viscosity and API gravity were measured for Crude Oil 02 and for Crude Oil 02 (Naptha+Pyrolysis Oil additive). The viscosity was measured for Crude Oil 02 (Xylene+Pyrolysis Oil additive). The API gravity for Crude Oil 02 (Xylene+Pyrolysis Oil additive) was estimated and the error bars for the API gravity value are based on a typical API gravity standard deviation.

Naphtha and crude oil condensate are typically used as diluents and dispersants to control the viscosity of the crude oil. Aromatic compounds such as xylene and toluene can also serve the same purpose. FIG. 3 shows two different crude oils that have been modified using additives comprising different dispersants, crude oil 01 with naphtha plus pyrolysis oil at a 1:24 ratio of pyrolysis oil to naphta (additive A) and crude oil 02 with xylene plus pyrolysis oil at a 1:24 ratio of pyrolysis oil to xylene (additive B). From the figure it can be seen that the additive made using naphtha as a dispersant does not provide adequate modification of crude oil 02, while xylene does provide adequate modification of this crude oil. However, the additive made using naphtha as a dispersant does provide adequate modification of crude oil 01. Thus, custom additives may be formulated by combining various fractions of pyrolysis oil with various dispersants to tailor the additive to particular needs.

All publications and patents referred to herein are incorporated by reference. Various modifications and variations of the described subject matter will be apparent to those skilled in the art without departing from the scope and spirit of the invention. Although the invention has been described in connection with specific embodiments, it should be understood that the invention as claimed should not be unduly limited to these embodiments. Indeed, various modifications for carrying out the invention are obvious to those skilled in the art and are intended to be within the scope of the following claims.

What is claimed is:

1. A crude oil additive comprising a pyrolysis oil fraction and a dispersant;

wherein the dispersant is a naphtha; and wherein the additive is substantially free of unfractionated pyrolysis oil.

2. The crude oil additive of claim 1, wherein the ratio of pyrolysis oil fraction to dispersant is from about 1:35 to about 4:1 (v/v).

3. The crude oil additive of claim 1, wherein the pyrolysis oil fraction is present in a concentration of at least 0.1% (v/v).

4. The crude oil additive of claim 1, wherein the additive does not comprise unfractionated pyrolysis oil.

5. The crude oil additive of claim 1, wherein the pyrolysis oil fraction is a pyrolysis sludge, a steam distillate top, a steam distillate bottom, a light distillate, a heavy distillate, a polar fraction, an aromatic fraction, an insoluble fraction, or combinations thereof.

6. A crude oil additive comprising a pyrolysis oil fraction and a dispersant selected from the group consisting of a naphtha, xylene, toluene, benzene, n-heptane, and styrene, wherein:

the additive is substantially free of unfractionated pyrolysis oil, and the percentage of terpene in the pyrolysis oil fraction is less than 1% (v/v).

7. The crude oil additive of claim 6, wherein the percentage of terpene in the pyrolysis oil fraction is less than 0.001% (v/v).

8. The crude oil additive of claim 6, wherein the terpene is limonene, cymene or combinations thereof.

9. A crude oil additive comprising a pyrolysis oil fraction and a dispersant selected from the group consisting of a naphtha, xylene, toluene, benzene, n-heptane, and styrene, wherein the pyrolysis oil fraction does not comprise limonene.

10. A crude oil additive comprising a pyrolysis oil fraction and a dispersant selected from the group consisting of a naphtha, xylene, toluene, benzene, n-heptane, and styrene, wherein the pyrolysis oil fraction does not comprise cymene.

11. The crude oil additive of claim 1, wherein the crude oil is a heavy crude oil.

12. The crude oil additive of claim 1, wherein the crude oil additive reduces the viscosity of crude oil.

13. The crude oil additive of claim 1, wherein the crude oil additive increases the API gravity of crude oil.

14. A method of preparing the crude oil additive of claim 1 comprising combining a pyrolysis oil fraction and a naphtha.

15. The method of claim 14, wherein the pyrolysis oil fraction is a pyrolysis sludge, steam distillate top, steam distillate bottom, light distillate, heavy distillate, polar fraction, aromatic fraction, insoluble fraction, or combinations thereof.

16. The method of claim 14, wherein the crude oil is a heavy crude oil.

17. A method of reducing the viscosity of crude oil comprising adding a crude oil additive comprising a pyrolysis oil fraction and a dispersant selected from the group consisting of a naphtha, xylene, toluene, benzene, n-heptane, and styrene; wherein the additive is substantially free of unfractionated pyrolysis oil;

to crude oil, thereby reducing the viscosity of the crude oil.

18. The method of claim 17, wherein the additive is added to the crude oil at a concentration of from about 5% to about 30% (v/v).

19. The method of claim 18, wherein the additive is added to the crude oil at a concentration of from about 15% to about 30% (v/v).

20. The method of claim 17, wherein the crude oil is a heavy crude oil.

21. A method of increasing the API gravity of a crude oil comprising adding the crude oil additive of claim 1 to crude oil, thereby increasing the API gravity of the crude oil.

22. The method of claim 21, wherein the additive is added to the crude oil at a concentration of from about 5% to about 30% (v/v).

23. The method of claim 22, wherein the additive is added to the crude oil at a concentration of from about 15% to about 30% (v/v).

24. The method of claim 21, wherein the crude oil is a heavy crude oil.

* * * * *